US009624680B2

(12) United States Patent
Atkinson

(10) Patent No.: US 9,624,680 B2
(45) Date of Patent: Apr. 18, 2017

(54) BRICKLAYING

(71) Applicant: Stephen Atkinson, Newark (GB)

(72) Inventor: Stephen Atkinson, Newark (GB)

( * ) Notice: Subject to any disclaimer, the term of this patent is extended or adjusted under 35 U.S.C. 154(b) by 0 days.

(21) Appl. No.: 15/048,092

(22) Filed: Feb. 19, 2016

(65) Prior Publication Data

US 2016/0244986 A1 Aug. 25, 2016

(51) Int. Cl.

| | |
|---|---|
| ***E04B 1/00*** | (2006.01) |
| ***E04G 21/00*** | (2006.01) |
| ***E04G 23/00*** | (2006.01) |
| ***E04G 21/22*** | (2006.01) |
| ***E04G 21/20*** | (2006.01) |
| ***E04F 21/18*** | (2006.01) |

(52) U.S. Cl.
CPC ..... *E04G 21/22* (2013.01); *E04F 21/18* (2013.01); *E04G 21/206* (2013.01)

(58) Field of Classification Search
CPC ..... E04G 21/22; E04G 21/206; E04F 13/147
USPC ..... 52/747.12
See application file for complete search history.

(56) References Cited

U.S. PATENT DOCUMENTS

| | | | | |
|---|---|---|---|---|
| 3,231,646 | A | 1/1966 | Conder et al. | |
| 5,231,729 | A * | 8/1993 | Rose | B44D 3/105 15/145 |
| 5,915,809 | A | 6/1999 | Gilliam | |
| 6,708,418 | B1 | 3/2004 | Schaefer | |
| 7,017,308 | B2 * | 3/2006 | Marshall | E04G 21/20 249/90 |
| 2004/0020145 | A1 | 2/2004 | Matsufuji | |
| 2005/0086901 | A1 | 4/2005 | Chisholm | |
| 2007/0044413 | A1 | 3/2007 | Gossett | |
| 2008/0006005 | A1 | 1/2008 | Bashour | |

FOREIGN PATENT DOCUMENTS

| | | | |
|---|---|---|---|
| CA | 2555093 | A1 | 2/2008 |
| EP | 0 183 652 | A2 | 6/1986 |
| EP | 1 449 976 | A1 | 8/2004 |
| EP | 2 339 093 | A1 | 6/2011 |
| ES | 2 156 648 | A1 | 7/2001 |
| GB | 1149741 | A | 4/1969 |
| GB | 2089863 | A | 6/1982 |
| GB | 2465743 | A | 6/2010 |
| NL | 1026521 | C2 | 1/2006 |

OTHER PUBLICATIONS

Bricky Pro, Nov. 8, 2013, www.brickytool.com/catalog/product_info.php/cPath/25/products_id/1012.

* cited by examiner

*Primary Examiner* — Patrick Maestri
(74) *Attorney, Agent, or Firm* — Renner, Otto, Boisselle and Sklar LLP

(57) ABSTRACT

There is provided a portable apparatus (10) for supporting and carrying a brick structure (22). The portable apparatus (10) includes a base (12) that is configured to carry, in use, the brick structure (22). The portable apparatus (10) also includes a position assembly (14) that has one or more position members (16). The or each position member (16) is configured to define, in use, a first layout for a plurality of bricks of the brick structure (22).

18 Claims, 12 Drawing Sheets

BRICKLAYING

This application claims priority of GB Application No. 1502876.4 filed Feb. 20, 2015, which is hereby incorporated herein by reference.

FIELD OF THE INVENTION

This invention relates to a portable apparatus for supporting and carrying a brick structure, to a method of laying a brick structure, and to a mortar application device.

BACKGROUND

It is known to lay a plurality of bricks, normally in layers, to build a brick structure.

SUMMARY OF THE INVENTION

According to a first aspect of the invention there is provided a portable apparatus for supporting and carrying a brick structure, the portable apparatus comprising:

a base configured to carry, in use, the brick structure; and a position assembly including one or more position members, the or each position member being configured to define, in use, a first layout for a plurality of bricks of the brick structure.

The provision of a portable apparatus with a base arranged to carry, in use, a brick structure permits portability of the brick structure, i.e. it becomes possible to transport the brick structure from one location to another location. For example, the base may be configured to be positioned, in use, underneath the brick structure when carrying the brick structure.

Being able to carry the brick structure and transport the brick structure from one location to another location is particularly useful when, for example, the desired location of the brick structure is not easily accessible or when space restrictions at the desired location makes it difficult to utilise the tools necessary to lay the brick structure.

The portable apparatus permits the building of a new brick structure or the modification of an existing brick structure. For example, if it is necessary to extend the height of a chimney, it can be difficult to build directly onto the chimney since it is positioned high above the ground and can be dangerous to access. The provision of a portable apparatus as outlined above therefore permits the building of a brick structure on the ground, and the brick structure can then be carried by the portable apparatus and positioned onto an existing chimney, so as to modify the chimney.

In addition, if the weather conditions at the desired location of the brick structure renders it difficult to lay the brick structure in-situ, the portable apparatus may be used to permit laying of the brick structure indoors or in a sheltered location before transporting the brick structure to the desired location. The brick structure as carried by the portable apparatus can then be moved, for example by hand or by machine such as a forklift vehicle, to the desired location.

Being able to carry the brick structure and transport the brick structure from one location to another location can also be useful for someone that is learning the trade of bricklaying. This is because he or she may take longer than an experienced bricklayer to lay a brick structure, and so laying the brick structure at the desired location may result in the presence of an unsightly, unfinished brick structure at the desired location for a prolonged period. The portable apparatus allows the less experienced bricklayer to take their time learning their trade by laying the brick structure in a safe environment, which may be indoors and hidden from adverse weather conditions, before transporting the finished brick structure to the desired location.

Meanwhile the provision of a position assembly in the portable apparatus permits a bricklayer to accurately position a plurality of bricks in accordance with the first layout defined by the or each position member so as to form a desired brick structure. For example, the or each position member may be arranged such that the first layout has a square cross-sectional profile in order for the resulting brick structure to take the form of a column. This not only ensures that the plurality of bricks are positioned in accordance with a predetermined layout, thus resulting in a stable and consistent layout of the brick structure, but also helps to train an unexperienced bricklayer who may otherwise have difficulties in accurately positioning the plurality of bricks by way of freehand arrangement, i.e. without the help of the position assembly.

Optionally the position assembly is moveable towards and away from the base to vary a space between the base and the position assembly.

Being able to vary the space between the base and the position assembly permits variation in the height of the brick structure. In this way the position assembly can be used throughout the building process for the brick structure irrespective of its desired height.

The portable apparatus may further include a first elongate support member secured to the base, wherein the base includes a carrier surface that surrounds the first elongate support member, the carrier surface being configured to carry, in use, the brick structure, and wherein the position assembly is moveable along the first elongate support member.

The carrier surface provides a means for carrying the brick structure. For example, the carrier surface may be configured to be positioned, in use, underneath the brick structure when the base is carrying the brick structure. Moreover arranging the carrier surface to surround the first elongate support member means that the brick structure built on the carrier surface also surrounds the first elongate support member and thereby conceals the first elongate support member.

In addition the position assembly being moveable along the first elongate support member allows the first elongate support member to act as a rail to guide the movement of the position assembly towards and away from the base.

The first elongate support member may be integral to the base. Alternatively the base and first elongate support member may be separate components, and the base and first elongate support member may be fixedly or removeably secured to one another.

Optionally the portable apparatus further includes a second elongate support member, the second elongate support member being removably secured to the first elongate support member. The provision of the second elongate support member increases the amount which the position assembly can be moved away from the base, and thereby increases the upper limit of the height of the brick structure that can be built on the base using the position assembly.

Preferably the base is a position member. Such a base can therefore define a first layout for a plurality of bricks of the brick structure. This is particularly useful to help ensure that a first layer of bricks laid on the base are aligned in a desired arrangement as defined by the first layout.

Optionally the position assembly is configured to define part or all of a perimeter of the first layout. Using the position assembly to define part or all of a perimeter of the first layout provides a reliable means of positioning the plurality of bricks to match the first layout.

The position assembly may include a first brick position member, the first brick position member including a first overhang arranged to abut, in use, at least a portion of the brick structure. The first overhang provides a physical stop to readily position a brick or a plurality of bricks in accordance with the first layout.

The first brick position member may include a mortar guide portion arranged to guide, in use, a position and/or define, in use, a thickness of mortar being applied to the brick structure.

Such an arrangement of the first brick position member aids in the application of mortar to the brick structure, e.g. a layer of a multi-layered brick structure, which results in uniform application of the mortar to the brick structure. The inclusion of the mortar guide portion in the first brick position member minimises the number of parts in the portable apparatus.

Optionally the position assembly includes a second brick position member, the second brick position member including a second overhang arranged to abut, in use, at least a portion of the brick structure, an overhang length of the second overhang being longer than an overhang length of the first overhang. The second overhang not only provides a physical stop to readily position a portion of the brick structure, but also by virtue of its longer overhang length permits alignment of multiple layers of bricks to build a stable and uniform brick structure.

Preferably the second brick position member is removeably secured to the first brick position member. This allows the second brick position member to be removed when its overhang length is longer than the height of the layer of bricks to be laid on the base, and to be secured to the first brick position member when its overhang length is the same as or shorter than the total height of the multiple layers of bricks to be laid on the base The second brick position member may include four corner overhang portions, each of the corner overhang portions forming the second overhang. The four corner overhand portions may be used to define a part of a perimeter of the first layout.

Optionally the position assembly includes an angular position member, the angular position member being arranged to define, in use, a second layout for a plurality of bricks of the brick structure, wherein the second layout is rotationally offset from the first layout.

Being able to define a second layout that is rotationally offset from the first layout means that a plurality of bricks (e.g. a layer of bricks) can be positioned on top of another layer of bricks and at a non-zero angle relative to the underlying layer of bricks. In this way a spiral brick column can be built on the base.

The angular position member may be rotatably coupled to the first elongate support member.

The portable apparatus may further include a mortar guide member, the mortar guide member having a mortar guide portion arranged to guide, in use, a position and/or define, in use, a thickness of mortar being applied to the brick structure. The mortar guide portion may be arranged to provide a reference level relative to the layer of bricks that corresponds to a desired thickness of mortar and/or to provide a stencil to define the position of the applied mortar.

The provision of a mortar guide member in the portable apparatus obviates the need for a bricklayer to apply mortar by freehand, which would require guesswork regarding the determination of the position and/or thickness of mortar to be applied to the brick structure.

Optionally the mortar guide portion of the first brick position member is cooperable with the mortar guide portion of the mortar guide member so as to guide, in use, a position and/or define, in use, a thickness of mortar being applied to the brick structure.

Configuring both mortar guide portions to be cooperable with one another in the manner set out above provides additional flexibility when it comes to guiding, in use, a position and/or defining, in use, a thickness of mortar being applied to the brick structure. For example, it may be desirable to have different positions and/or thicknesses of the applied mortar, and the different positions and/or thicknesses can be provided by each of the mortar guide portions individually and by both of the mortar guide portions in combination.

According to a second aspect of the invention, there is provided a method of laying a brick structure, the method comprising the steps of:

- providing a base at a first location;
- providing a position assembly including one or more position members, the or each position member being configured to define, in use, a first layout for a plurality of bricks of the brick structure;
- placing a plurality of bricks on the base and defining the first layout using the or each position member;
- positioning the plurality of bricks in accordance with the first layout to form the brick structure;
- transporting the brick structure to a second location by carrying the brick structure on the base.

The method of laying a brick structure according to the second aspect of the invention shares the advantages set out above in relation to the portable apparatus according to the first aspect of the invention.

The method of laying a brick structure may permit the building of a new brick structure or the modification of an existing brick structure.

Preferably the method includes the steps of moving the or each position member towards and away from the base to vary the space between the base and the position assembly.

According to a third aspect of the invention, there is provided a mortar application device, for applying mortar between adjacent bricks, comprising a mortar carrier having a receptacle, the receptacle including an opening at one end thereof, the opening being arranged in the receptacle so as to permit mortar being held, in use, in the receptacle to be pushed through the opening to vacate the receptacle.

The mortar application device permits straightforward application of mortar between adjacent bricks, which can otherwise be difficult and messy in the absence of such a mortar application device.

Preferably the receptacle includes an applicator guide portion adjacent to the opening.

Optionally the mortar application device further includes a mortar applicator, the mortar applicator having a receptacle guide portion, wherein the mortar applicator is configured to be operable to push the mortar being held, in use, in the receptacle through the opening to vacate the receptacle, the receptacle guide portion being cooperable with the applicator guide portion to guide the movement of the mortar applicator during its operation to push the mortar being held, in use, in the receptacle through the opening to vacate the receptacle.

The provision of the mortar applicator permits the mortar to be easily pushed from the receptacle and between adjacent bricks. Meanwhile the receptacle guide portion and the applicator guide portion cooperate to guide the movement of the mortar applicator relative to the mortar carrier so as to provide the required pushing action.

The receptacle guide portion may be a slot.

Optionally the position assembly is shaped to cooperate with the mortar carrier so as to support, in use, the mortar carrier such that the opening faces towards the base. Further optionally the mortar guide member is shaped to cooperate with the mortar carrier so as to support, in use, the mortar carrier such that the opening faces towards the base.

Such an arrangement helps to position the mortar carrier in a desired position relative to the brick structure.

According to a fourth aspect of the invention, there is provided a method of modifying an existing brick structure comprising the step of using a guide assembly including one or more guide members, the or each guide member being configured to define, in use, a layout for a plurality of bricks to build an extension of the existing brick structure so as to form a modified brick structure, wherein the step of building the extension includes integrating at least one of the guide members into the modified brick structure so that it is hidden from view.

Integrating one of the guide members into the modified brick structure permits use of the guide assembly to aid in building the extension to the existing brick structure whilst it is forming part of the modified brick structure. In this way, the guide assembly is contained within the dimensions of the existing brick structure compared to a guide assembly which is external to and separate from the modified brick structure. Moreover, the guide member being integrated with the modified brick structure provides structural rigidity to the modified brick structure. Meanwhile, the integrated guide member being hidden from view means that it does not affect the appearance of the modified brick structure.

The method may comprise the steps of:

- positioning a first guide member onto the existing brick structure;
- attaching an elongate support member to the first guide member;
- moving a second guide member along the elongate support member towards and away from the first guide member to vary the space between the first guide member and the second guide member;
- building the extension on top of the first guide member and in accordance with the layout provided by the second guide member so as to form a modified brick structure, the first guide member being integrated into the modified brick structure so that it is hidden from view.

Positioning a first guide member onto the existing brick structure provides a platform onto which the extension can be built. The dimensions of the first guide member are preferably smaller than the existing brick structure such that the modified brick structure hides the first guide member from view. Meanwhile, attaching an elongate support member to the first guide member and moving a second guide member in the manner set out above permits a layout for guiding the building of the extension such that it can take a particular shape, for example a column.

Optionally, the method comprises the step of removing the elongate support member from the first guide member after the modified brick structure has been built. Such a step means that only the first guide member remains integrated into the modified brick structure and the elongate support member and second guide member, can be reused.

BRIEF DESCRIPTION OF THE DRAWINGS

There now follows a brief description of preferred embodiments of the invention, by way of non-limiting examples, with reference being made to the following figures in which.

DETAILED DESCRIPTION

Figure 1:
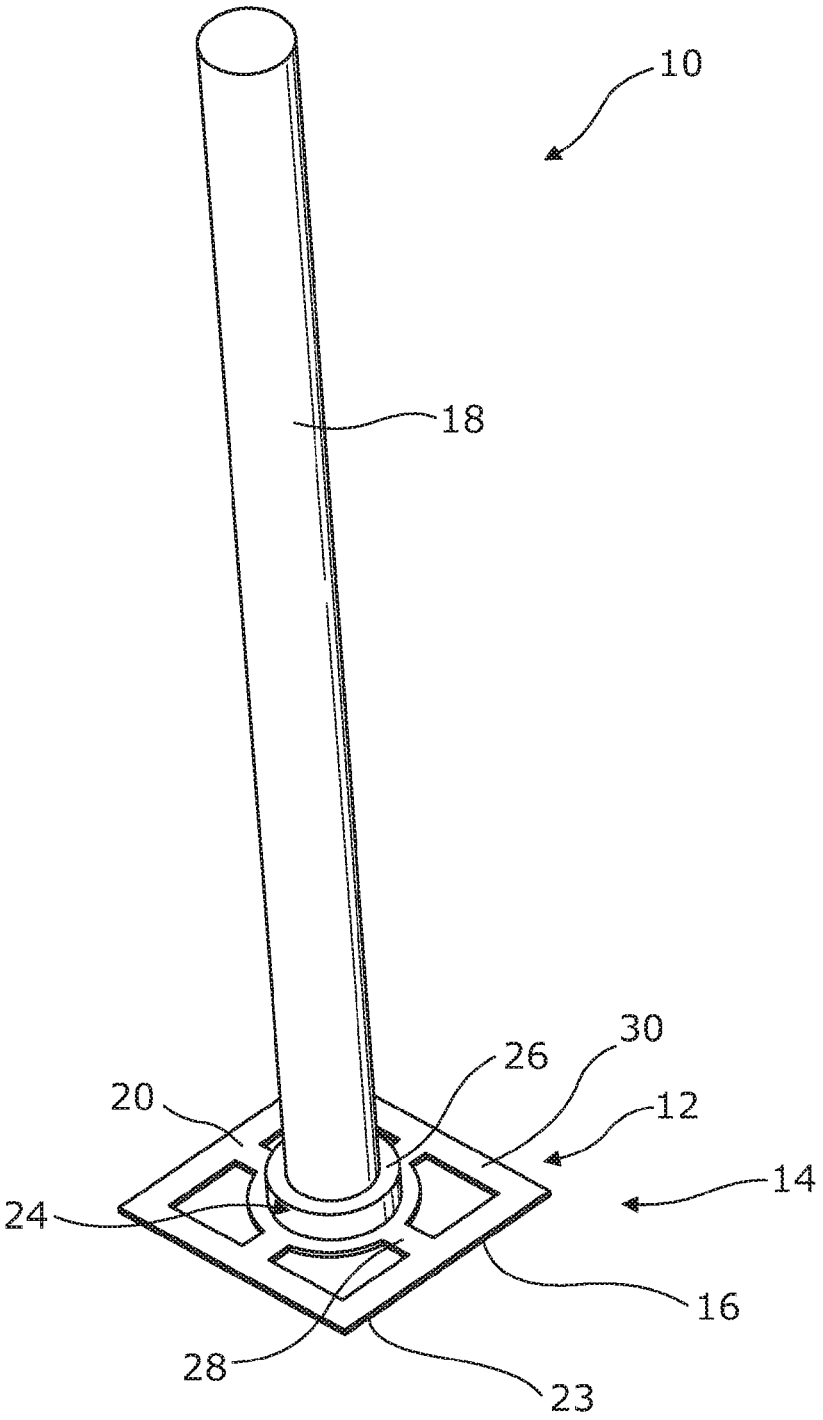
FIGS. 1 to 4 show schematically a portable apparatus according to a first embodiment of the invention.

A portable apparatus according to a first embodiment of the invention is shown in FIGS. 1 to 6*b* and is designated generally by reference numeral 10.

As shown in FIG. 1, the portable apparatus 10 has a base 12 that is configured to carry, in use, a brick structure.

It will be appreciated that there are standard dimensions of bricks, and these standard dimensions may vary from country to country. As such it will be understood that the portable apparatus 10, and parts thereof, can be made so as to match the standard dimensions of bricks in a particular country.

Figure 3:
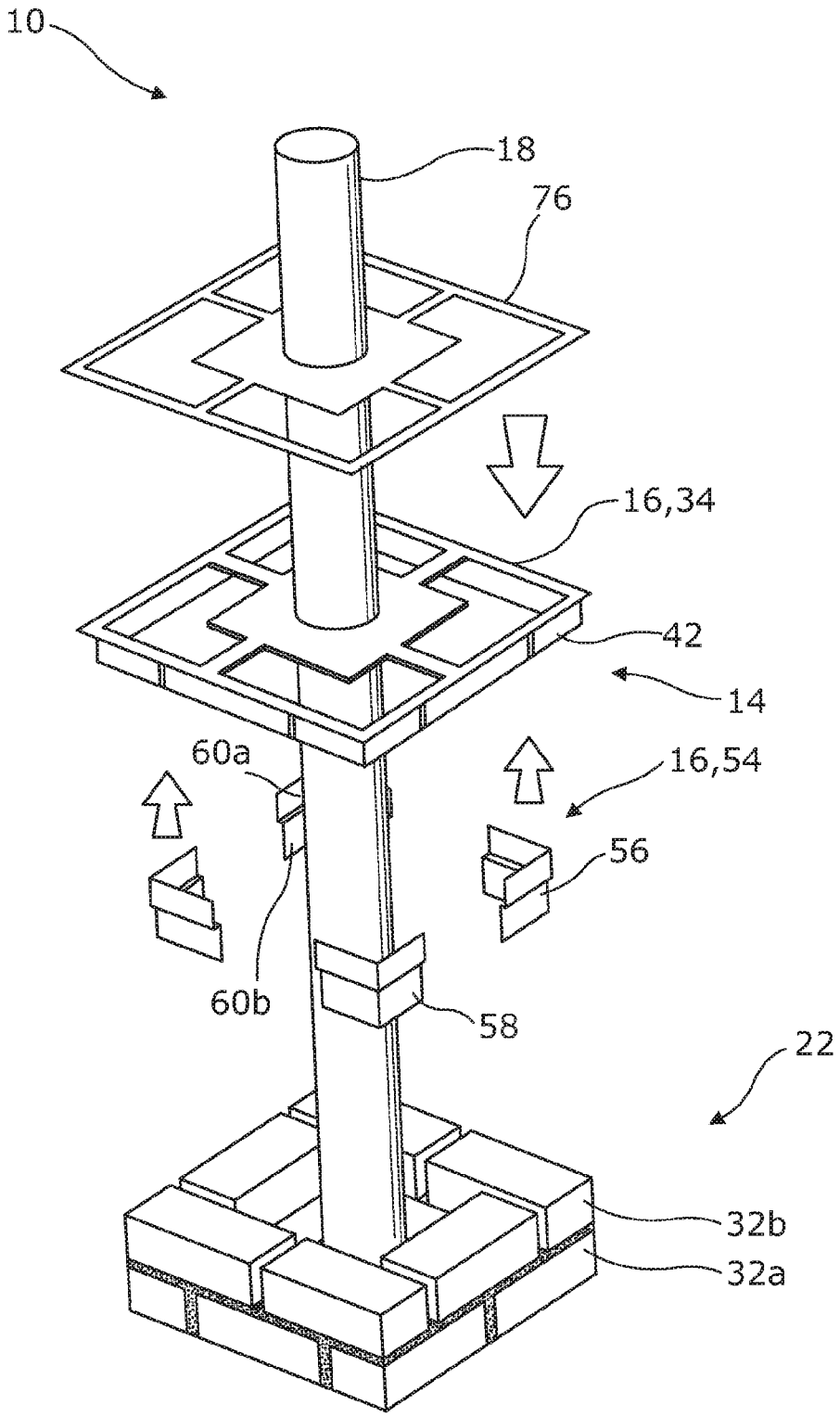

The portable apparatus 10 also includes a position assembly 14. The position assembly 14 includes a plurality of position members 16 (as shown in FIG. 3), wherein each position member 16 is configured to define, in use, a first layout for a plurality of bricks of the brick structure.

Figure 2:
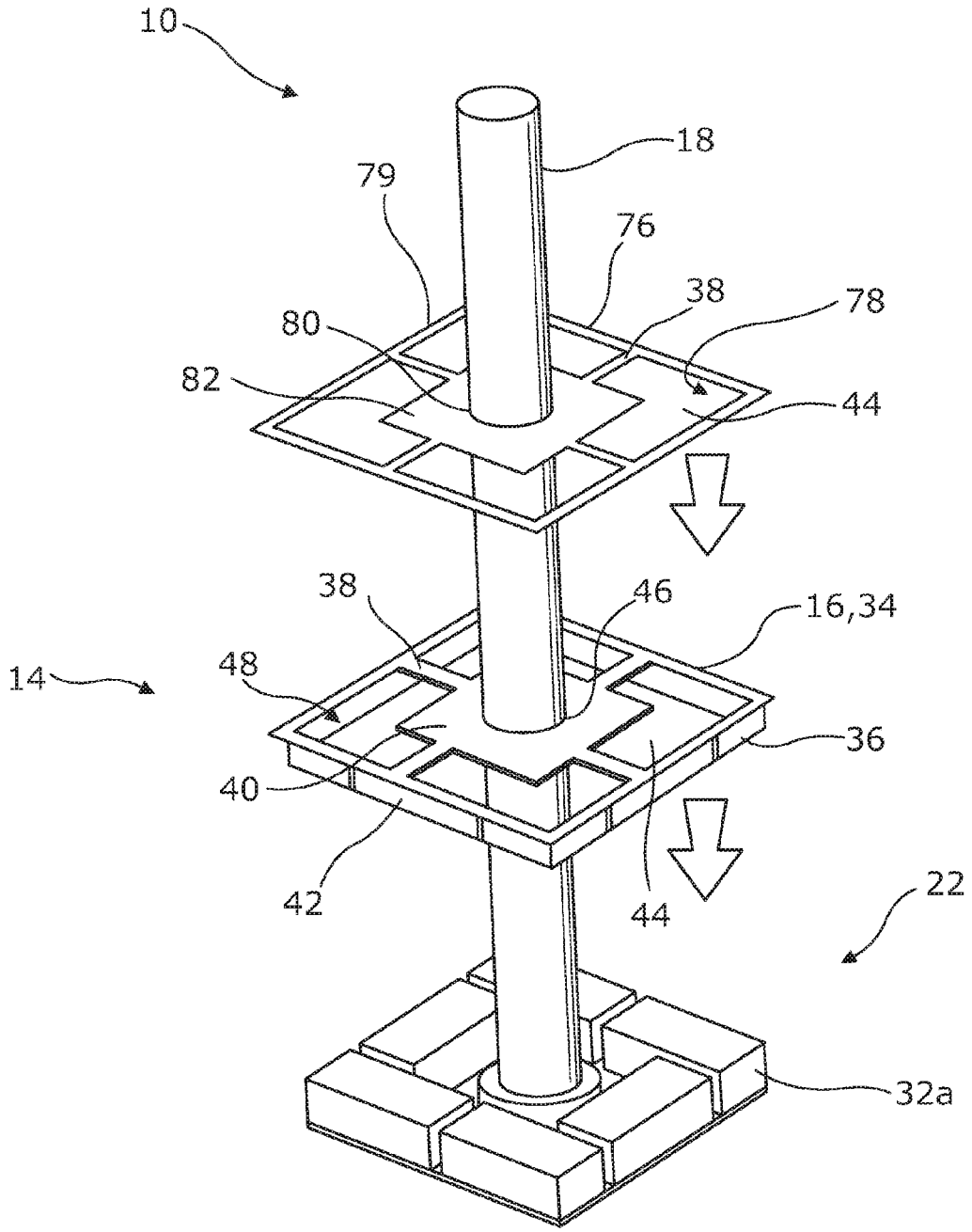

The portable apparatus 10 further includes a first elongate support member 18 that is removeably secured to the base 12. The base 12 has a carrier surface 20 that is configured to carry, in use, the brick structure. As shown in FIG. 2, for example, a brick structure 22 is built on top of the carrier surface 20. The carrier surface 20 surrounds the first elongate support member 18.

Returning to FIG. 1, the base 12 is in the form of a grid 23. The grid 23 is secured at a central portion 24 thereof to a bottom end of the first elongate support member 18 by a collar 26.

In this embodiment, the base 12 is a square shape and includes a number of support portions 28 (in this example there are four support portions 28) that each extend from the central portion 24 of the grid 23 to a perimeter 30 of the grid 23. In this way, the brick structure 22 built on top of the base 12 will be in the form of a column that surrounds the support member 18.

Moreover, the support portions 28 and perimeter 30 define the carrier surface 20, and as such they support the bricks laid thereupon to permit the carrying of the brick structure 22. In other embodiments, the base 12 may take a different form, such as rectangular, so as to permit different types of brick structures to be built.

Moreover, the perimeter 30 of the grid 23 defines the first layout for a plurality of bricks (more specifically a first layer of bricks 32*a*) of the brick structure 22. In this way, the base 12 also acts as a position member 16.

In this embodiment, the first elongate support member 18 is in the form of a hollow, circular pipe. In other embodiments, the first elongate support member may take a different form, such as a square pipe or a solid member. The first elongate support member 18 may typically have a height of 1.5 m and a diameter of 100 mm.

The position assembly 14 also includes a first brick position member 34 which is shown in FIG. 2. The first brick position member 34 has a first overhang 36 that is arranged to abut, in use, at least a portion of the brick structure 22.

In this embodiment, the first brick position member 34 is in the form of a square (which matches the shape of the base 12). More specifically, the first brick position member 34 includes a number of structural portions 38 (in this example there are four structural portions 38) that extend from a central portion 40 to a perimeter 42 of the first brick position member 34. The structural portions 38 give the first brick position member 34 structural rigidity while allowing sufficient gaps 44 for mortar to be applied in between the structural portions 38.

The first overhang 36 extends around the perimeter 42 of the first brick position member 34, thus defining all of a perimeter of the first layout.

In other embodiments, the first overhang 36 may only extend around portions of the first brick position member 34, such as the corners, so as to define part of a perimeter of the first layout.

The first brick position member 34 is slidably coupled to the first elongate support member 18 via an aperture 46 at the central portion 40 of the first brick position member 34. The first brick position member 34 can move along the first elongate support member 18. More specifically, the first brick position member 34 is moveable towards and away from the base 12 so as to vary a space between the base 12 and the first brick position member 34.

The first brick position member 34 also has a mortar guide portion 48 which is arranged to guide, in use, a position and define, in use, a thickness of mortar being applied to the brick structure 22.

Figure 5:
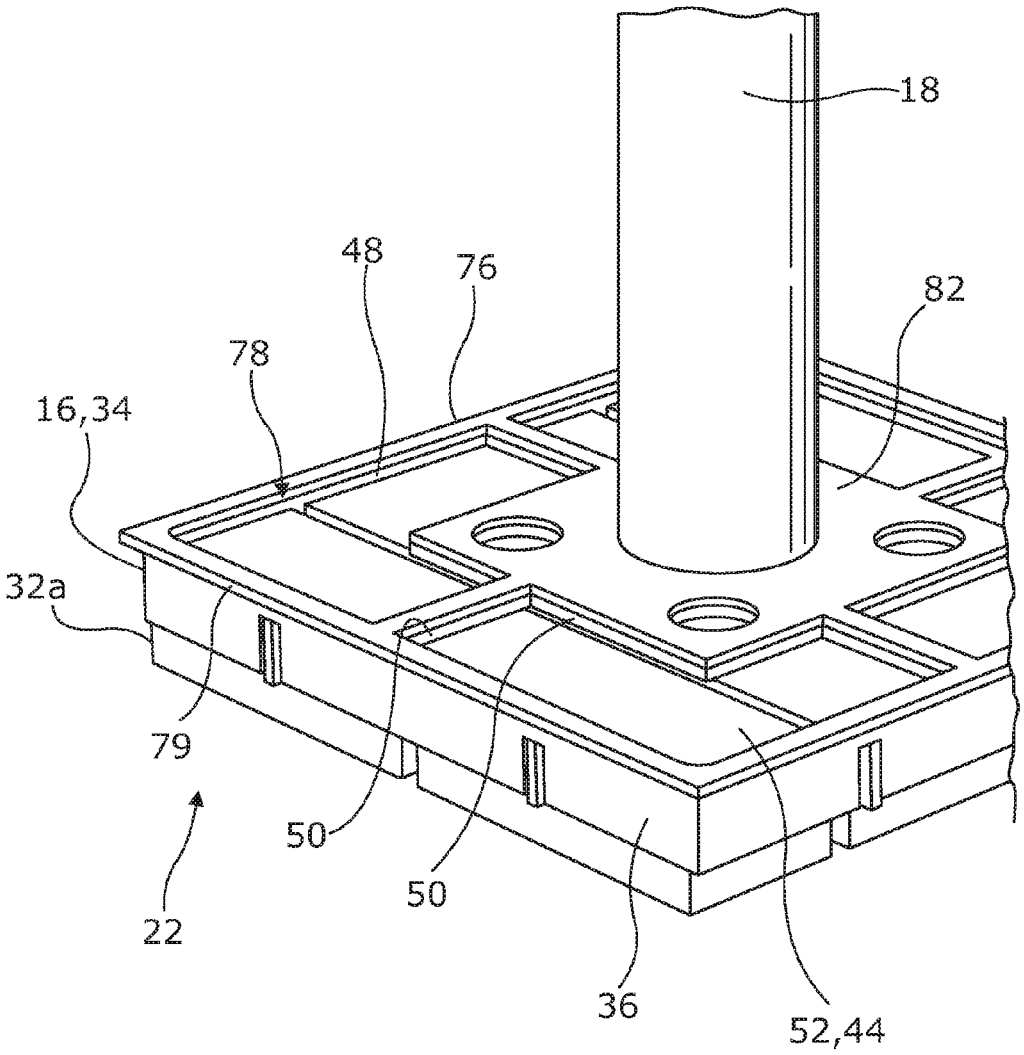
FIG. 5 shows a portion of the position member shown in FIG. 2.

As shown more clearly in FIG. 5, the mortar guide portion 48 includes a mortar thickness guide 50 which is defined by a portion of a wall extending around the perimeter 42 of the first brick position member 34 that extends beyond a top surface of a layer of bricks 32*a* laid underneath. The portion of wall extending beyond the top surface of the layer of bricks 32*a* may typically be 6 mm, thus resulting in a mortar thickness of 6 mm.

Moreover, the mortar guide portion 48 includes a mortar position guide 52 which is defined by the gaps 44 that are formed between the structural portions 38 and the perimeter 42 of the first brick position member 34.

Moving onto FIG. 3, the position assembly 14 further includes a second brick position member 54. The second brick position member 54 has a second overhang 56 that is arranged to abut, in use, a plurality of bricks of the brick structure 22. The overhang length of the second overhang 56 is longer than an overhang length of the first overhang 36.

In this embodiment, the second brick position member 54 includes four corner overhang portions 58 which form the second overhang 56. Each of the corner overhang portions 58 are removeably secured to the first brick position member 34 by, for example, a securing member such as a bolt. The securing member may instead be a screw. Alternatively, each corner overhang portion 58 may be removeably secured to the first brick position member 34 by a snap fit connection or a clasp.

Each of the corner overhang portions 58 has an attachment portion 60*a* and an abutment portion 60*b*. Each attachment portion 60*a* cooperates with a respective corner of the first brick position member 34 for securing purposes, while each abutment portion 60*b* abuts an outward face of more than one layer of bricks (i.e. a first layer 32*a* and a second layer 32*b* of bricks) of the brick structure 22.

The abutment portion 60*b* of each corner overhang portion 58 is in line, i.e. directly underneath when assembled, with the first overhang 36 of the first brick position member 34. In this way, the alignment of each layer of bricks is consistent.

The second brick position member 54 may instead have a continuous overhang portion (not shown) which extends around the perimeter 42 of the first brick position member 34.

Alternatively, the second brick position member 54 may be a separate component that is itself slidably secured to the first elongate support member 18 (therefore allowing movement towards and away from the base 12 so as to vary the space between the base 12 and the second brick position member 54). In this way, the second brick position member 54 is not secured to the first brick position member 34 and can be used independently.

Figure 4:
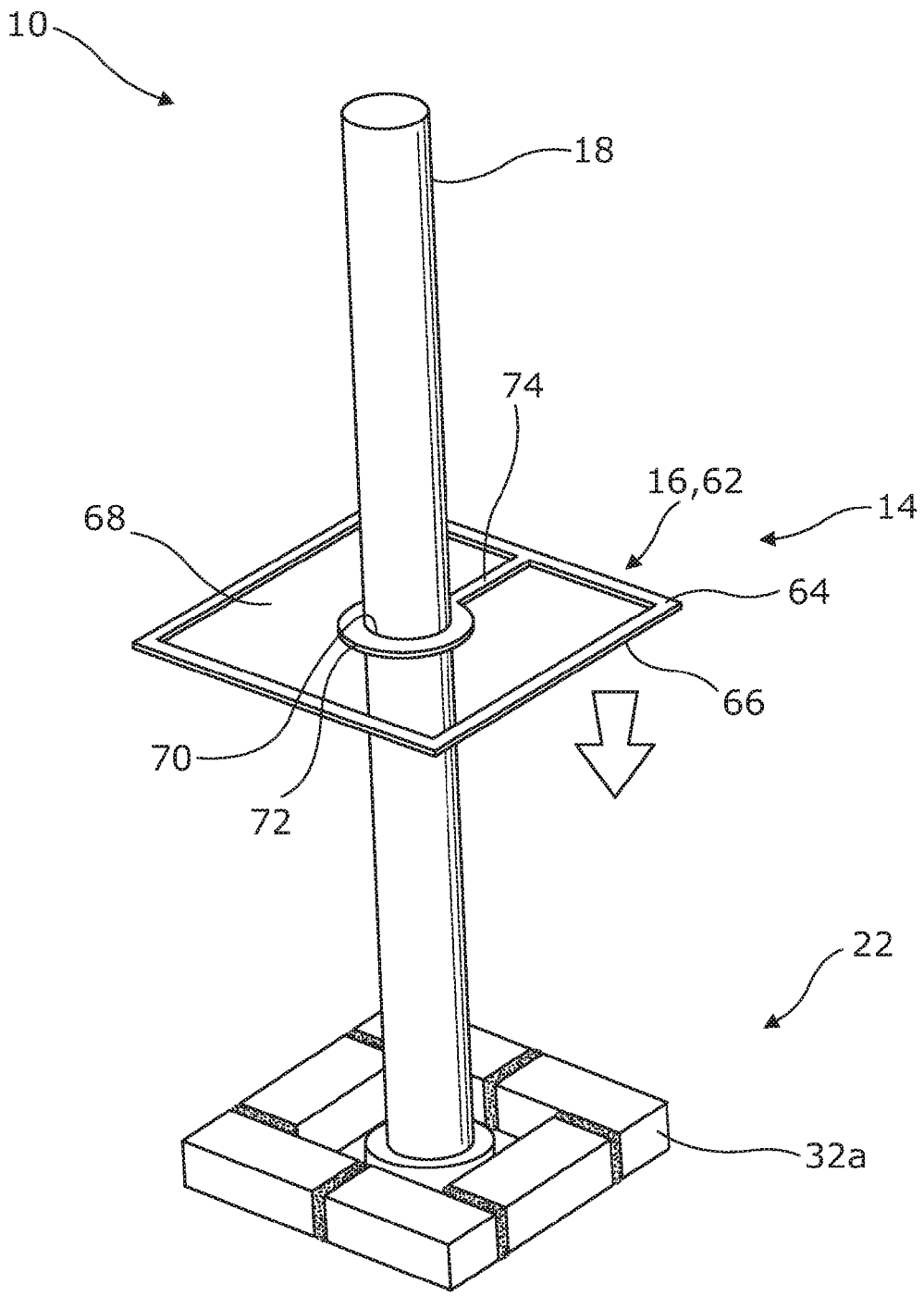

In addition to the foregoing, the position assembly 14 includes an angular position member 62 that is rotatably coupled to the first elongate support member 18. The angular position member 62 is shown in FIG. 4. The angular position member 62 is arranged to define, in use, a second layout for a plurality of bricks forming the brick structure 22, wherein the second layout is rotationally offset from the first layout.

In this embodiment, the angular position member 62 is in the form of a grid 64 which has a square perimeter 66. The perimeter 66 of the angular position grid 64 provides a full perimeter of the second layout for a plurality of bricks to be laid thereupon. The perimeter 66 also defines a gap 68 that permits the passing of bricks therethrough.

The angular position member 62 is rotatably coupled to the first elongate support member 18 via an aperture 70 at a central portion 72 of the angular position member 62.

The angular position member 62 also has an angular indicator portion 74 which extends from the central portion 72 to the perimeter 66. The angular indicator portion 74 can be used to measure an angle relative to the first elongate support member 18 so that the position of the angular position member 62 can be rotationally offset from the layer of bricks laid 32*a*, 32*b* underneath by a predetermined angle.

In this way, each layer of bricks 32*b* laid upon the angle position member 62 can be rotationally offset from the previous layer of bricks 32*a* by an angle so that the resulting brick structure 22 is a spiral column.

The angular position member 62 is also slidably coupled to the first elongate support member 18 such that is can move along the first elongate support member 18. More specifically, the angular position member 62 is moveable towards and away from the base 12 so as to vary the space between the base 12 and the angular position member 62.

Returning to FIG. 2, the portable apparatus 10 also includes a mortar guide member 76. The mortar guide member 76 has a mortar guide portion 78 arranged to guide, in use, a position and define, in use, a thickness of mortar being applied to the brick structure 22.

The mortar guide portion 78 of this embodiment is shown in more detail in FIG. 5. The mortar guide portion 78 is similar to that of the first brick position member 34, and like features are indicated by identical reference numerals.

However the mortar thickness guide 50 of the mortar guide member 76 is defined by a portion of a wall extending around a perimeter 79 of the mortar guide member 76 that extends beyond a top surface of the first brick position member 34.

The portion of wall extending beyond the top surface of the first brick position member 34 may also typically be 6 mm, thus resulting in a mortar thickness of 12 mm when combined with the mortar guide portion 48 of the first brick position member 34. The mortar guide member 76 may instead be used on its own to define a mortar thickness of 6 mm.

Alternatively, the mortar guide member 76 may not be cooperable with the mortar guide portion 48 of the first brick position member 34. In this embodiment, the mortar guide portion 78 of the mortar guide member 76 is instead defined by a portion of a wall extending around the perimeter 79 of the mortar guide member 76 that extends beyond a top surface of a layer of bricks 32*a*, 32*b* laid underneath.

The mortar guide member 76 is slidably coupled to the first elongate support member 18 via an aperture 80 at a central portion 82 of the mortar guide member 76. The mortar guide member 76 can move along the first elongate support member 18. More specifically, the mortar guide member 76 is moveable towards and away from the base 12 so as to vary the space between the base 12 and the mortar guide member 76.

The portable apparatus 10 further includes a second elongate support member 84. The second elongate support member 84 is selectively secured to a top end of the first elongate support member 18.

Figure 6A:
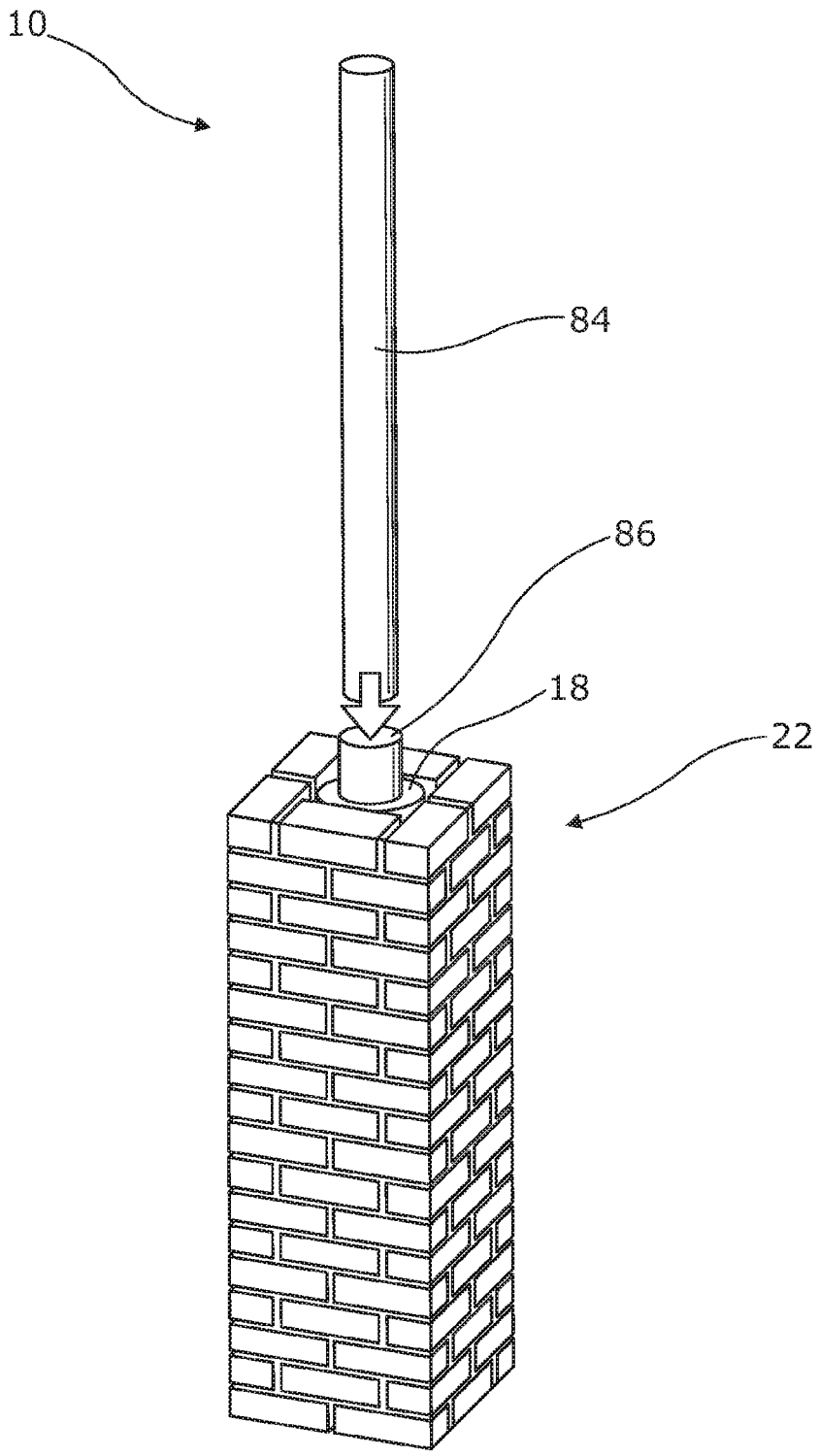
FIG. 6*a* shows schematic of the portable apparatus shown in FIG. 1 including a second elongate support member.

In the embodiment shown at FIG. 6*a*, a collar 86 can be fitted to the top end of the first elongate support member 18 so that the collar 86 can receive the second elongate support member 84. Alternatively, the first elongate support member 18 can be replaced by a support member that includes a collar 86 at the top end.

Figure 6B:
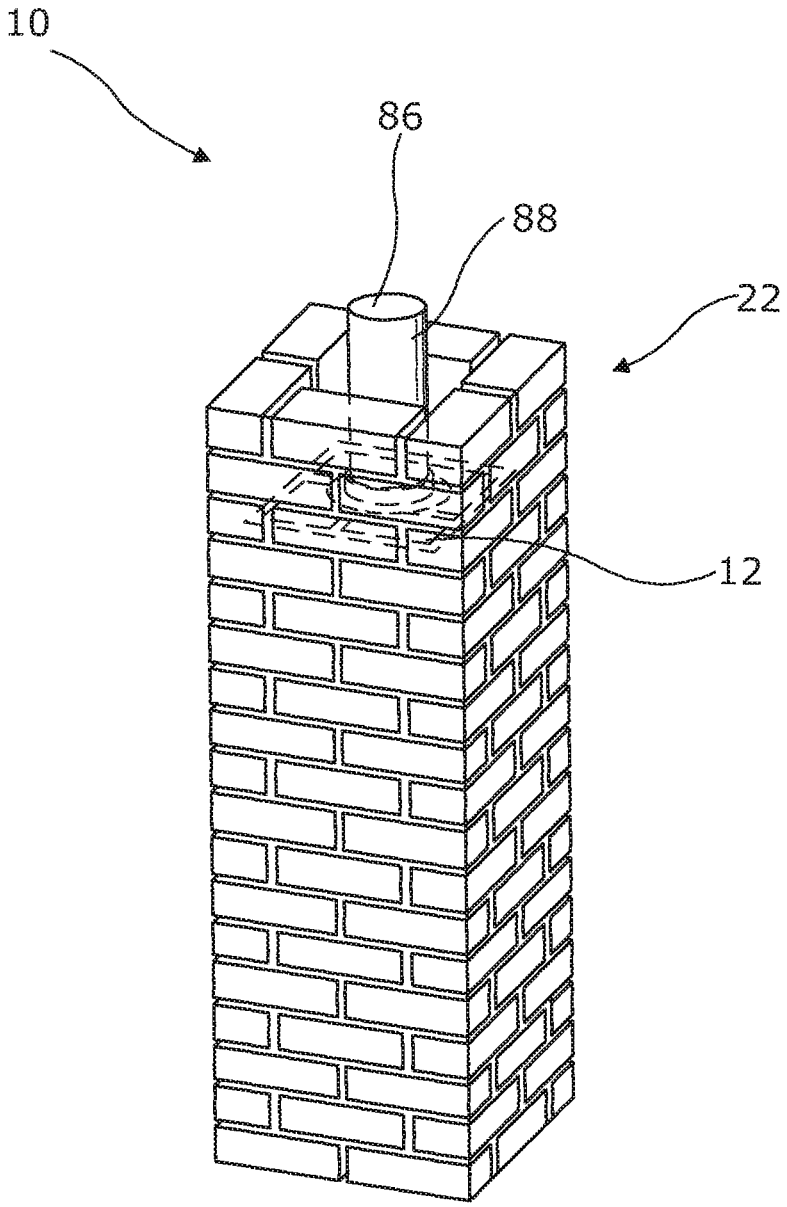
FIG. 6*b* shows an alternative arrangement of the second elongate support member shown in FIG. 6*a;*

In the embodiment shown in FIG. 6*b*, the first elongate support member 18 is removed and a shorter first elongate support member 88 that includes a collar 86 at the top end is inserted to a base 12. At least 3 layers of bricks are then build around the shorter first elongate support member 88 before securing the second elongate support member 84 to the shorter first elongate support member 88. In this embodiment, the second elongate support member 84 may in fact be the first elongate support member 18 that has been removed and replaced by the shorter first elongate support member 88. In this way, the collarless first elongate support member 18 can be re-used.

Figure 7A:
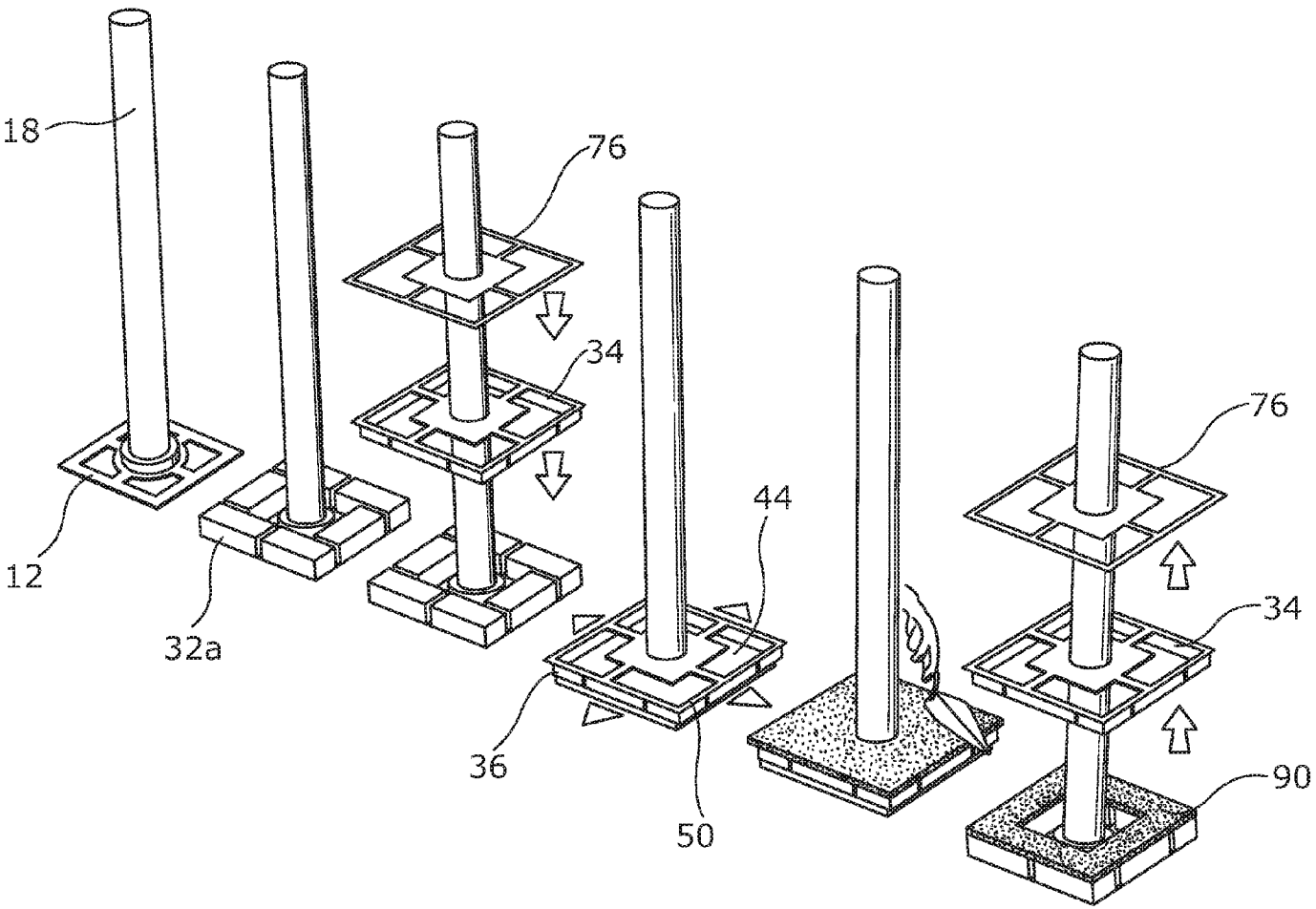
FIG. 7*a* shows steps associated with using the portable apparatus shown in FIGS. 1 and 2.
Figure 7B:
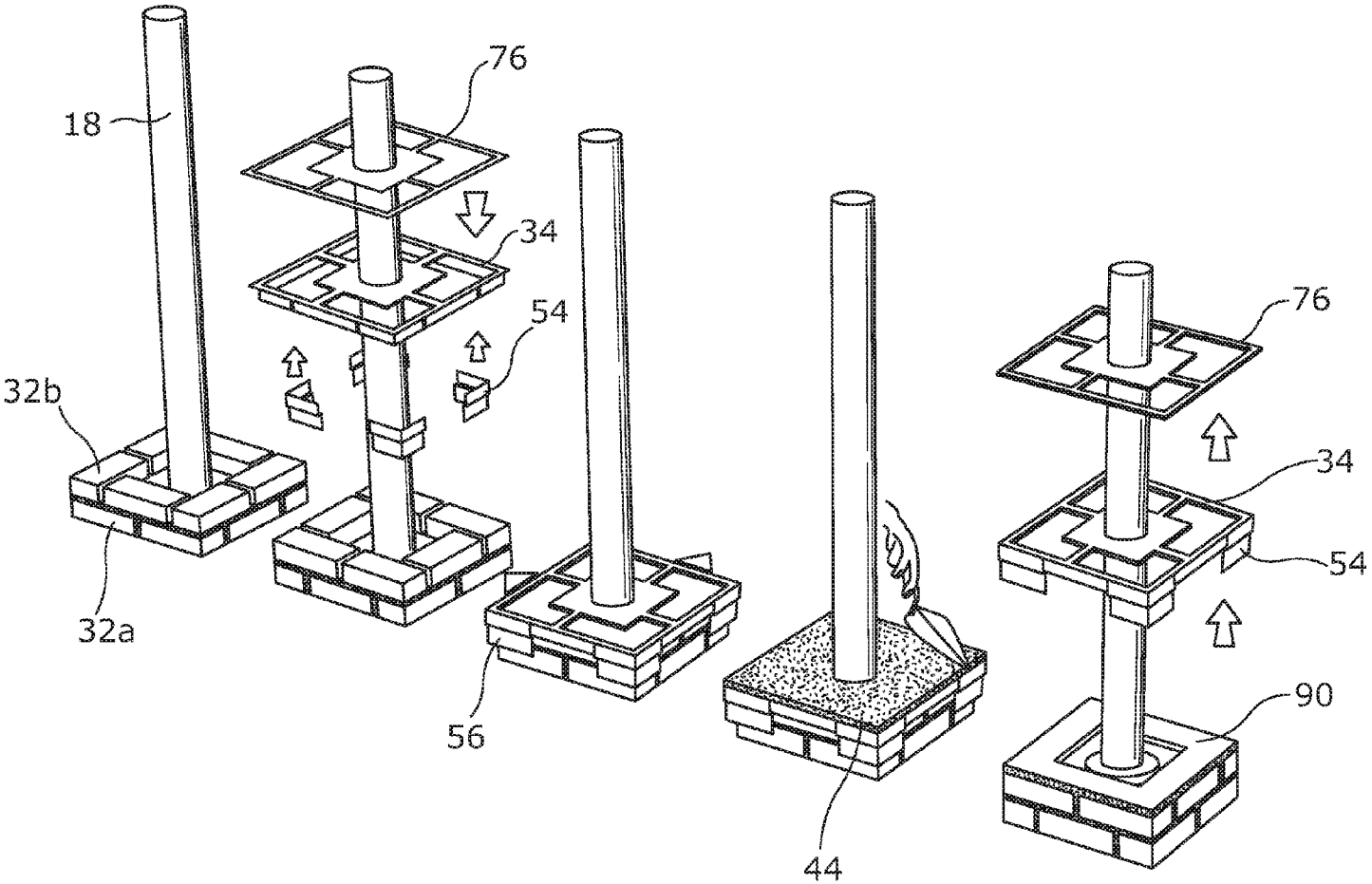
FIG. 7*b* shows steps associated with using the portable apparatus shown in FIGS. 1 to 3.
Figure 7C:
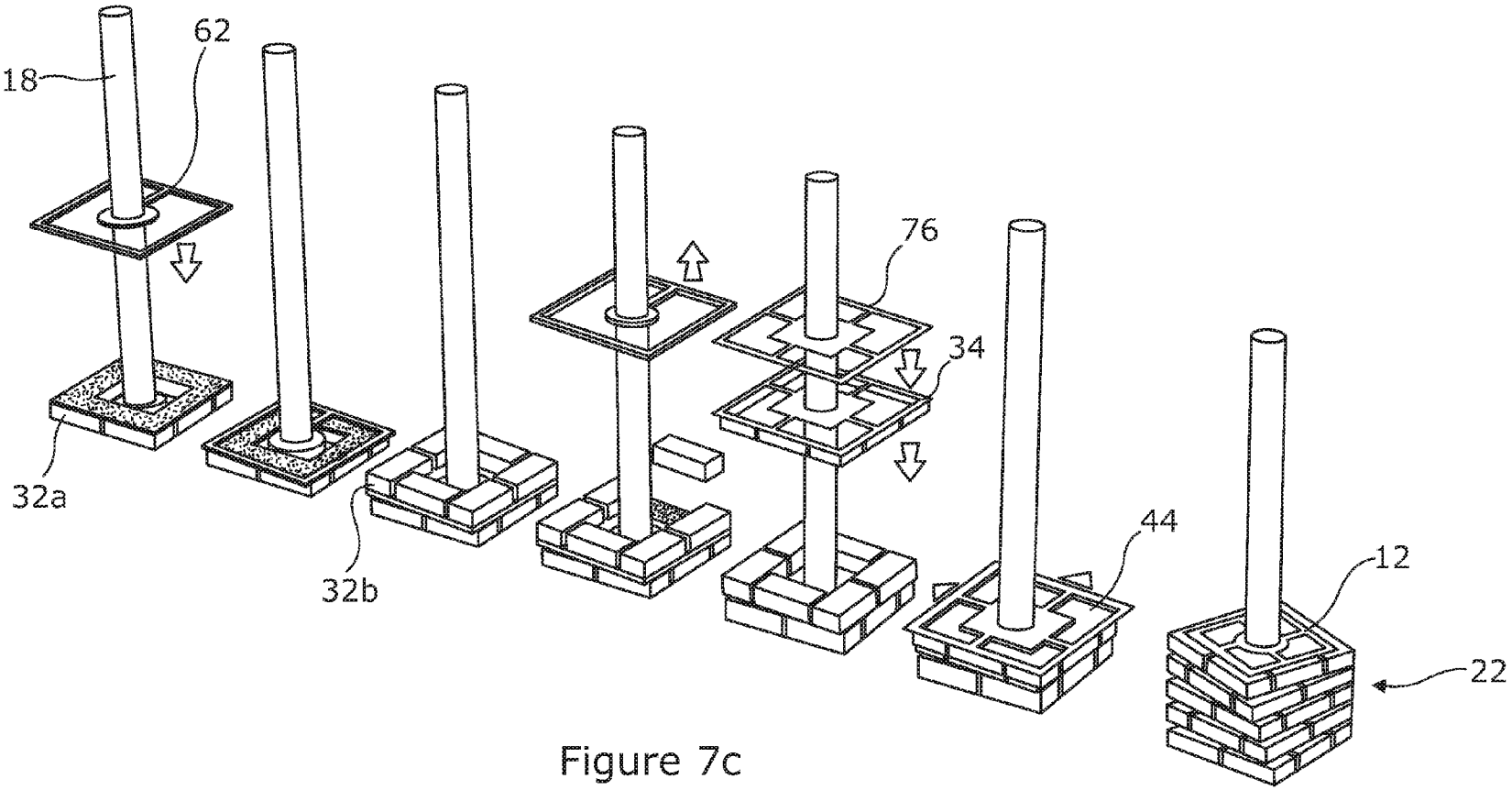
FIG. 7*c* shows steps associated with using the portable apparatus shown in FIGS. 1 to 4.

A step-by-step illustration of the portable bricklaying apparatus 10 in use is shown in FIGS. 7*a* to 7*c*.

Starting with FIG. 7*a*, in use, the base 12 is placed on a surface (e.g. the ground) and the first elongate support member 18 is secured at its bottom end to the central portion 24 of the base 12 via the collar 26.

A plurality of bricks are placed on the carrier surface 20 of the base 12 to form the first layer of bricks 32*a*. The perimeter 30 of the base 12 provides the first layout for the positioning of the first layer of bricks 32*a*.

Next, the first brick position member 34 is slid, via its central aperture 46, down the first elongate support member 18 to meet the top surface of the first layer of bricks 32*a*. Each brick can then be moved so that an outer face abuts the first overhang 36.

The mortar guide member 76 is also slid, via its central aperture 80, down the first elongate support member 18 to meet the first brick position member 34. The mortar guide portions 48, 78 of both the mortar guide member 76 and the first brick position member 34 cooperate with one another.

Mortar 90 can now be laid in the gaps 44 (i.e. the position guides 52) formed in the mortar guide member 76 and the first brick position member 34. The mortar 90 is laid to the level defined by the thickness guide 50 defined by the mortar guide member 76 and the first brick position member 34.

Once the mortar 90 is laid, the mortar guide member 76 and the first brick position member 34 can then be slid up the first elongate support member 18 and removed therefrom.

Next, as shown at FIG. 7*b*, a second layer of bricks 32*b* are placed on top of the first layer of mortar 90. The first brick position member 34 is again slid down the first elongate support member 18 to meet the top surface of the second layer of bricks 32*b*.

Each of the corner overhang portions 58 are secured to a respective corner of the first brick position member 34, and each brick in the second layer of bricks 32*b* can be moved so that an outer face abuts a respective corner overhang portion 58. Each corner overhang portion 58 has a length that allows it to also abut a portion of the first layer of bricks 32*a*.

The mortar guide member 76 is slid down the first elongate support member 18 to meet the first brick position member 34, and the same steps as outlined above are carried out so as to form a second layer of mortar 90 on the second layer of bricks 32*b*.

These steps are repeated so as to build a column brick structure 22 to a desired height. The brick structure 22 can then be carried via the base 12 to a desired location on its own or onto an existing brick structure so as to modify the existing brick structure.

Turning to FIG. 7*c*, alternatively, after laying the first layer of bricks 32*a* and mortar 90, the angular position member 62 can be slid, via its central aperture 70, down the first elongate support member 18 to meet the first layer of mortar 90. The angular indicator portion 74 can then be used to define the second layout which lies at a desired angle relative to the first layout (i.e. relative to the first layer of bricks 32*a*).

Subsequently, a second layer of bricks 32*b* can be placed on the angular position member 62 and positioned in accordance with the second layout defined by the perimeter 66 of the angular position member 62.

A brick that is obstructing the angular indicator portion 74 is then removed so as to allow the angular position member 62 to be slid up the first elongate support member 18 (passing the remaining bricks via its gap 68) and removed therefrom. The removed brick is replaced, and then the first brick position member 34 and the mortar guide member 76 is used to position the second layer of bricks 32*b* as outlined above in relation to the first layer of bricks 32*a*. In this instance, the second layer of bricks 32*b* will be rotationally offset from the first layer of bricks 32*a*.

The angular position member 62 is again slid down the first elongate support member 18 to meet the second layer of mortar 90 and the steps above are repeated so as to form a spiral brick column 22.

It may be desirable, particularly when building spiral brick column 22, to introduce another base 12 every 3 to 5 layers of bricks so as to provide structural rigidity.

In the event that the height of the brick structure 22 exceeds that of the first elongate support member 18, the second elongate support member 84 can be attached to the top end of the first elongate support member 18 (as shown in FIGS. 6*a* and 6*b*).

Figure 8:
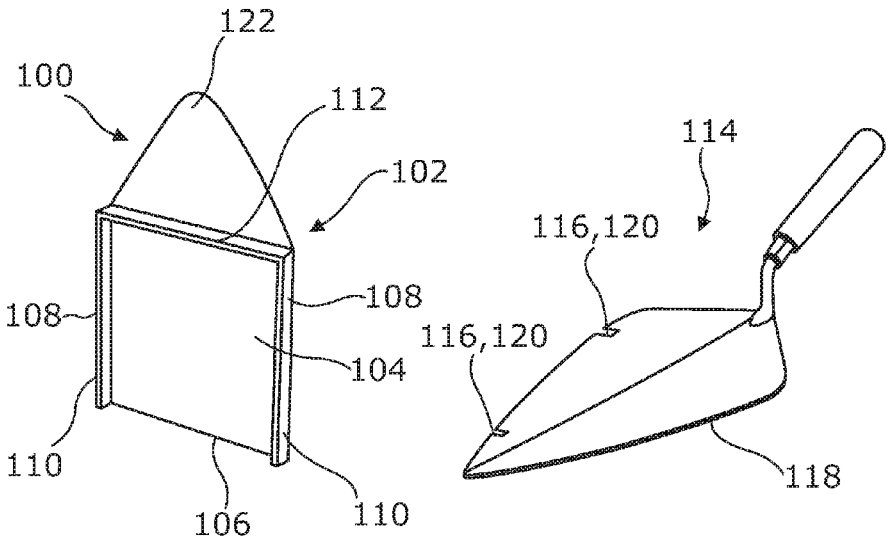
FIG. 8 shows a schematic of a mortar application device according to a second embodiment of the invention.

A mortar application device according to a second embodiment of the invention is shown in FIG. 8 and is designated generally by reference numeral 100.

The mortar application device 100 includes a mortar carrier 102 that has a receptacle 104. The receptacle 104 has an opening 106 at one end thereof, and the opening 106 is arranged in the receptacle 104 so as to permit mortar 90 being held in the receptacle 104 to be pushed through the opening 106 to vacate the receptacle 104.

In this embodiment, the receptacle 104 includes two walls 108 that lie opposite one another. Each wall 108 lies adjacent to the opening 106 and each wall 108 includes an applicator guide portion 110. The receptacle 104 also includes a connecting wall 112 that connects the two walls 108 at an end of the receptacle 104 that lies opposite the opening 106.

The mortar application device 100 further includes a mortar applicator 114 which has two receptacle guide portions 116. Each receptacle guide portion 116 is cooperable with a respective applicator guide portion 110. The mortar applicator 114 is configured to push the mortar 90 being held in the receptacle 104 through the opening 106 to vacate the receptacle 104.

In this embodiment, the mortar applicator 114 is a trowel 118 which has two receptacle guide portions 116 in the form of slots 120.

The mortar application device 100 further includes a handle portion 122 that extends from the receptacle 104 at an opposite end to the opening 106.

Figure 9:
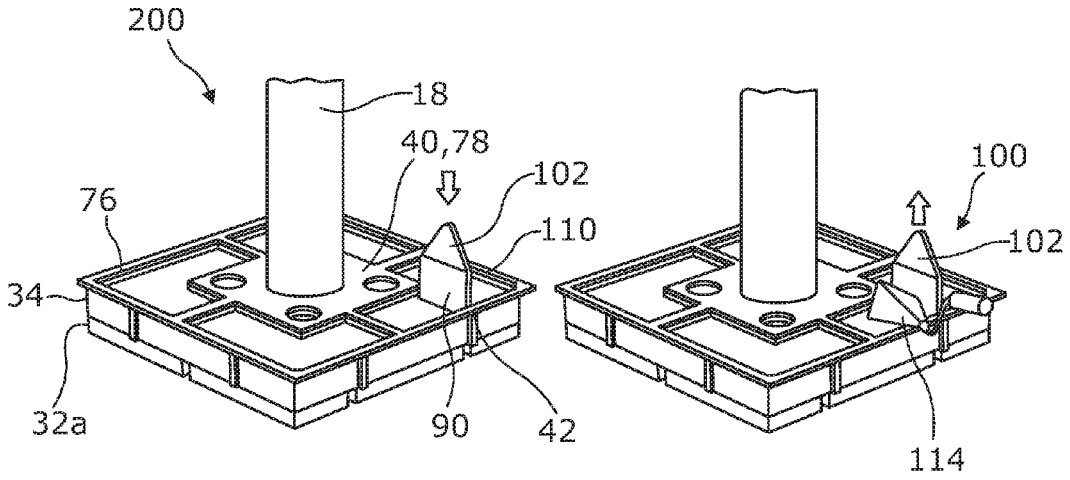
FIG. 9 shows a schematic of a mortar application device cooperating with the portable apparatus according to a third embodiment of the invention.

FIG. 9 shows a mortar application device according to a third embodiment of the invention, which is designated generally by the reference numeral 200.

The mortar application device 200 of the third embodiment is similar to the mortar application device 100 of the second embodiment and identical features share the same reference numerals.

The mortar application device 200 is cooperable with the portable apparatus 10 of the first embodiment of the invention. More specifically, one of the two walls 108 of the receptacle 104 abuts the central portion 40, 82 of both the first brick position member 34 and the mortar guide member 76, while the other wall 108 of the receptacle 104 abuts the perimeter 42, 79 of the both the first brick position member 34 and the mortar guide member 76.

A back face of the mortar carrier 102 abuts a structural portion 38 of both the first brick position member 34 and the mortar guide member 76 so that the opening 106 of the receptacle 104 faces towards the base 12 and is in line with a gap between the bricks.

The receptacle guide portions 116 engage with respective applicator guide portions 110 such that, in use, the mortar applicator 114 pushes mortar 90 being held in the receptacle 104 down towards the opening 106 and into the gap formed by adjacent bricks.

Figure 10:
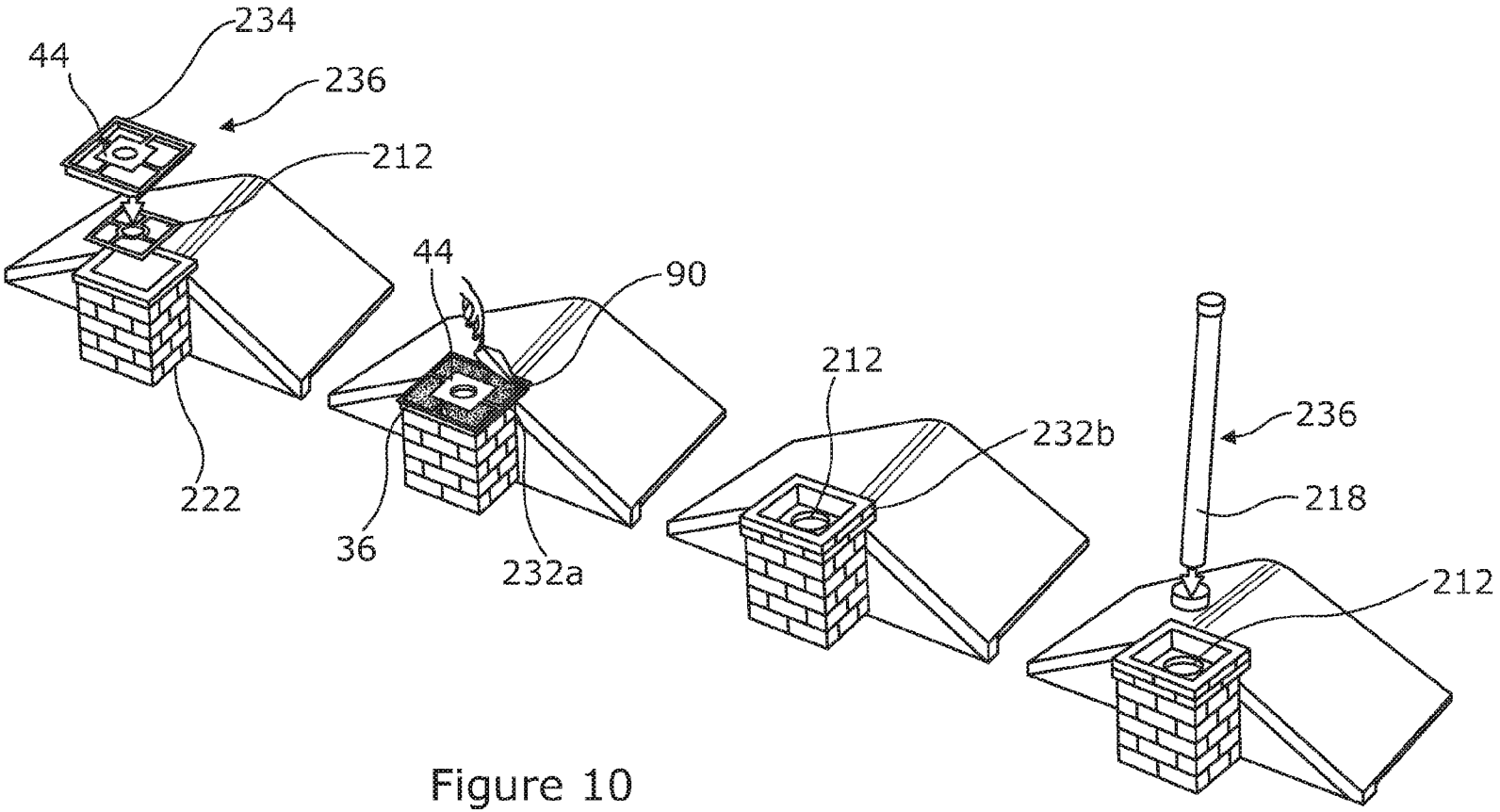
FIG. 10 shows steps associated with the method of modifying an existing brick structure according to a fourth embodiment of the invention.

FIG. 10 shows the steps of a method of modifying an existing brick structure 222 according to a fourth embodiment of the invention. The steps include positioning a first guide member, i.e. a base 212, of a guide assembly 236 onto an existing brick structure 222. The existing brick structure 222 in this embodiment is a chimney. The existing brick structure 222 may take another form. The base 212 is similar to the base 12 as described hereinabove in relation to the first embodiment of the invention and identical features share the same reference numerals.

A first layer of bricks 232*a* is laid on top of the base 212 and a second guide member 234 is placed over the first layer of bricks 232. The second guide member 234 is similar to the first brick position member 34 as herein described above in relation to the first embodiment of the invention, and identical features share the same reference numerals.

Each brick of the first layer of bricks 232*a* is positioned so that an outer surface abuts the first overhang 36 of the second guide member 234. Mortar 90 is then laid in the gaps 44 formed in the second guide member 234. A mortar guide member 76 as described above in relation to the first embodiment of the invention may also be placed on top of the brick position member 234 before the mortar 90 is applied.

The second guide member 234 (and the mortar guide member 76, if used) is then removed and the mortar 90 is left to set.

A second layer of bricks 232*b* is then placed on top of the set mortar 90. An elongate support member 218 is then attached to the base 212. The elongate support member 218 is secured to the base 212 via a collar 226.

The second guide member 234, as described hereinabove, is then slid down the elongate support member 218 so as to vary the space between the second guide member 234 and the base 212. An extension is then built in accordance with the step-by-step illustration as shown in FIGS. 7*a* to 7*c* and described above so as to form a modified brick structure, for example a column modified brick structure.

Once the modified brick structure is built, the elongate support member 218 and the second guide member 234 are then removed from the base 212.

The invention claimed is:

1. A portable apparatus for supporting and carrying a brick structure, the portable apparatus comprising:

a base configured to carry, in use, the brick structure; and a position assembly including one or more position members, the or each position member being configured to define, in use, a first layout for a plurality of bricks of the brick structure, wherein the position assembly includes a first brick position member, the first brick position member including a first overhang arranged to abut, in use, at least a portion of the brick structure, the first overhang extending around at least a portion of the perimeter of the first brick position member so as to define at least a part of a perimeter of the first layout of the brick structure; and a mortar guide member, the mortar guide member having a mortar guide portion arranged to guide, in use, a position and/or define, in use, a thickness of mortar being applied to the brick structure;

wherein the first brick position member includes a mortar guide portion arranged to guide, in use, a position and/or define, in use, a thickness of mortar being applied to the brick structure, and wherein the mortar guide portion of the first brick position member is cooperable with the mortar guide portion of the mortar guide member so as to guide, in use, a position and/or define, in use, a thickness of mortar being applied to the brick structure.

2. A portable apparatus according to claim 1 wherein the position assembly is moveable towards and away from the base to vary the space between the base and the position assembly.

3. A portable apparatus according to claim 2 further including a first elongate support member secured to the base, wherein the base includes a carrier surface that surrounds the first elongate support member, the carrier surface being configured to carry, in use, the brick structure, and wherein the position assembly is moveable along the first elongate support member.

4. A portable apparatus according to claim 3 further including a second elongate support member, the second elongate support member being removably secured to the first elongate support member.

5. A portable apparatus according to claim 1 wherein the position assembly includes a second brick position member, the second brick position member including a second overhang arranged to abut, in use, at least a portion of the brick structure, an overhang length of the second overhang being longer than an overhang length of the first overhang.

6. A portable apparatus according to claim 5 wherein the second brick position member is removeably secured to the first brick position member.

7. A portable apparatus according to claim 5 wherein the second brick position member includes four corner overhang portions, each of the corner overhang portions forming the second overhang.

8. A portable apparatus according to claim 1 wherein the position assembly includes an angular position member, the angular position member being arranged to define, in use, a second layout for a plurality of bricks of the brick structure, wherein the second layout is rotationally offset from the first layout.

9. A method of laying a brick structure, the method comprising the steps of:

providing a base at a first location;

providing a position assembly including one or more position members, the or each position member being configured to define, in use, a first layout for a plurality of bricks of the brick structure, wherein the position assembly includes a first brick position member, the first brick position member including a first overhang arranged to abut, in use, at least a portion of the brick structure, the first overhang extending around at least a portion of the perimeter of the first brick position member so as to define at least a part of a perimeter of the first layout of the brick structure;

providing a mortar guide member, the mortar guide member having a mortar guide portion arranged to guide, in use, a position and/or define, in use, a thickness of mortar being applied to the brick structure, wherein the first brick position member includes a mortar guide portion arranged to guide, in use, a position and/or define, in use, a thickness of mortar being applied to the brick structure, wherein the mortar guide portion of the first brick position member is cooperable with the mortar guide portion of the mortar guide member so as to guide, in use, a position and/or define, in use, a thickness of mortar being applied to the brick structure;

placing a plurality of bricks on the base and defining the first layout using the or each position member;

positioning the plurality of bricks in accordance with the first layout to form the brick structure;

applying mortar to the brick structure by arranging the mortar guide portion of the first brick position member to cooperate with the mortar guide portion of the mortar guide member so as to guide, in use, a position and/or define, in use, a thickness of the mortar being applied to the brick structure;

transporting the brick structure to a second location by carrying the brick structure on the base.

10. A method according to claim 9 including the step of moving the or each position member towards and away from the base to vary the space between the base and the position assembly.

11. A combination of a mortar application device for applying mortar between adjacent bricks and a portable apparatus for supporting and carrying a brick structure;

wherein the mortar application device includes a mortar carrier having a receptacle, the receptacle including an opening at one end thereof, the opening being arranged in the receptacle so as to permit mortar being held, in use, in the receptacle to be pushed through the opening to vacate the receptacle, wherein the portable apparatus includes a base configured to carry, in use, the brick structure; and a position assembly including one or more position members, the or each position member being configured to define, in use, a first layout for a plurality of bricks of the brick structure, wherein the position assembly includes a first brick position member, the first brick position member including a first overhang arranged to abut, in use, at least a portion of the brick structure, the first overhang extending around at least a portion of the perimeter of the first brick position member so as to define at least a part of a perimeter of the first layout of the brick structure, wherein the position assembly is shaped to cooperate with the mortar carrier so as to support, in use, the mortar carrier such that the opening faces towards the base.

12. A combination of a mortar application device for applying mortar between adjacent bricks and a portable apparatus for supporting and carrying a brick structures;

wherein the mortar application device includes a mortar carrier having a receptacle, the receptacle including an opening at one end thereof, the opening being arranged in the receptacle so as to permit mortar being held, in use, in the receptacle to be pushed through the opening to vacate the receptacle, wherein the portable apparatus includes a base configured to carry, in use, the brick structure; and a position assembly including one or more position members, the or each position member being configured to define, in use, a first layout for a plurality of bricks of the brick structure, wherein the position assembly includes a first brick position member, the first brick position member including a first overhang arranged to abut, in use, at least a portion of the brick structure, the first overhang extending around at least a portion of the perimeter of the first brick position member so as to define at least a part of a perimeter of the first layout of the brick structure; and a mortar guide member, the mortar guide member having a mortar guide portion arranged to guide, in use, a position and/or define, in use, a thickness of mortar being applied to the brick structure, wherein the mortar guide member is shaped to cooperate with the mortar carrier so as to support, in use, the mortar carrier such that the opening faces towards the base.

13. A combination of a mortar application device and a portable apparatus according to claim 11 wherein the receptacle includes an applicator guide portion adjacent to the opening.

14. A combination of a mortar application device and a portable apparatus according to claim 13 further including a mortar applicator, the mortar applicator having a receptacle guide portion, wherein the mortar applicator is configured to be operable to push the mortar being held, in use, in the receptacle through the opening to vacate the receptacle, the receptacle guide portion being cooperable with the applicator guide portion to guide the movement of the mortar applicator during its operation to push the mortar being held, in use, in the receptacle through the opening to vacate the receptacle.

15. A combination of a mortar application device and a portable apparatus according to claim 14 wherein the receptacle guide portion is a slot.

16. A combination of a mortar application device and a portable apparatus according to claim 12 wherein the receptacle includes an applicator guide portion adjacent to the opening.

17. A combination of a mortar application device and a portable apparatus according to claim 16 further including a mortar applicator, the mortar applicator having a receptacle guide portion, wherein the mortar applicator is configured to be operable to push the mortar being held, in use, in the receptacle through the opening to vacate the receptacle, the receptacle guide portion being cooperable with the applicator guide portion to guide the movement of the mortar applicator during its operation to push the mortar being held, in use, in the receptacle through the opening to vacate the receptacle.

18. A combination of a mortar application device and a portable apparatus according to claim 17 wherein the receptacle guide portion is a slot.

* * * * *